US005688005A

United States Patent [19]

Ellis

[11] Patent Number: 5,688,005

[45] Date of Patent: Nov. 18, 1997

[54] DOOR KNOB SPINDLE WITH SPRING

[75] Inventor: Philip C. Ellis, Reading, Pa.

[73] Assignee: Baldwin Hardware Corporation, Reading, Pa.

[21] Appl. No.: 678,005

[22] Filed: Jul. 10, 1996

[51] Int. Cl.[6] ..... E05B 3/00

[52] U.S. Cl. ..... 292/348; 292/349; 292/353

[58] Field of Search ..... 292/353, 348, 292/349, 355, 357

[56] References Cited

U.S. PATENT DOCUMENTS

| | | | |
|---|---|---|---|
| 1,653,514 | 12/1927 | Schlage | 292/348 |
| 2,015,918 | 10/1935 | Brabant | 292/349 |
| 3,019,045 | 1/1962 | Jaggi | 292/353 |
| 3,130,990 | 4/1964 | Leitmann | 292/349 |
| 3,427,061 | 2/1969 | McMeen et al. | 292/357 |
| 4,679,420 | 7/1987 | Yang | 292/348 |
| 4,995,249 | 2/1991 | Preissler et al. | 70/224 |
| 5,398,531 | 3/1995 | Shen | 292/348 |

FOREIGN PATENT DOCUMENTS

| | | | |
|---|---|---|---|
| 404869 | 2/1969 | Australia | 292/353 |
| 545667 | 9/1957 | Canada | 292/353 |
| 1040932 | 2/1954 | German Dem. Rep. | 292/353 |
| 795479 | 5/1958 | United Kingdom | 292/348 |

*Primary Examiner*—Rodney M. Lindsey

*Attorney, Agent, or Firm*—Edgar A. Zarins; Malcolm L. Sutherland

[57] ABSTRACT

A lock assembly with a lock spindle extending perpendicular from the internal lock mechanism and the door. A knob or lever is operably connected to the spindle such that rotation thereof operates the lock mechanism. In order to eliminate any movement between the spindle and knob or lever and thereby eliminate rattle or inoperative rotation of the knob, a bow spring is longitudinally mounted to the spindle. The ends of the spring are retained on the spindle as the spring bows radially outwardly from the spindle to frictionally engage an inner wall of the knob or lever.

8 Claims, 1 Drawing Sheet

DOOR KNOB SPINDLE WITH SPRING

BACKGROUND OF THE INVENTION

I. Field of the Invention

This invention relates to door lock assemblies and, in particular, to a lock spindle with a spring which biasingly engages a knob or lever to eliminate movement therebetween and any rattle or play.

II. Description of the Prior Art

Lock assemblies for a door generally include an internal locking mechanism which operates a bolt extending from the door into the door jamb and is operably controlled by levers or knobs. A lock spindle extends from the internal lock mechanism perpendicular to the door. The operating knob or lever is mounted to the spindle such that rotation of the knob or lever translates to the lock mechanism for movement of the bolt.

The spindles used to support the outside knobs in ANSI Series 4000 bored-through locks are usually made from steel rolled into a tube with open, unwelded seam. In addition to the seam, there are typically additional longitudinal cuts or slots. These spindles can be made to relatively close tolerances with no longitudinal draft and are nominally radially compressible. The knobs for such locks are hollow stampings with a tubular shank which matingly receives the spindle. The resulting assembly is relatively free of rattle or play since these rolled and stamped parts can be manufactured within close tolerances. Excessive play is undesirable exhibiting poor quality and workmanship.

While the manufacturing tolerances can be more closely controlled with stamped components, die castings require greater tolerances. Die castings can be manufactured with more detail as necessary. However, because the spindle and knob shank require longitudinal draft on both parts and die castings lack the necessary resiliency, undesirable play develops between the spindle and the shank of the knob or lever.

SUMMARY OF THE PRESENT INVENTION

The present invention overcomes the disadvantages of the prior known lock assemblies by providing die cast components incorporating means for biasing the knob construction to the lock spindle to eliminate undesirable play therebetween.

The lock assembly of the present invention includes a locking mechanism mounted within a door and having a bolt transversely extendable into the door jamb and a lock spindle extending from the locking mechanism substantially perpendicular to the door. Preferably the spindle is a zinc die casting. Operably connected to the spindle is a knob or lever assembly which allows the user to operate the lock assembly. The door knob preferably comprises a solid knob body having a shank mounted thereto and a decorative shank cover for concealing the zinc die cast shank. The door knob assembly matingly receives the shank for combined rotation therewith.

The excess clearance inherent in this assembly requires means for rotating the spindle with the knob while also eliminating the excess movement between the components. The spindle includes a pair of lugs which engage corresponding slots or notches on the knob assembly. The lugs and notches are disposed or sized such that the knob or lever can only be assembled onto the spindle in the proper orientation. As a result, rotation of the knob will translate to the lugs and spindle. To eliminate rotational play and rattle of the knob assembly on the spindle, a bow spring is mounted longitudinally on the spindle. The spring bows radially outwardly from the spindle to bias against an interior wall of the knob shank eliminating the freedom of play between the components. The ends of the spring are received within a slot on the spindle shielded from gouging the knob shank.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the view and in which.

DETAILED DESCRIPTION OF A PREFERRED EMBODIMENT OF THE PRESENT INVENTION

Figure 1:
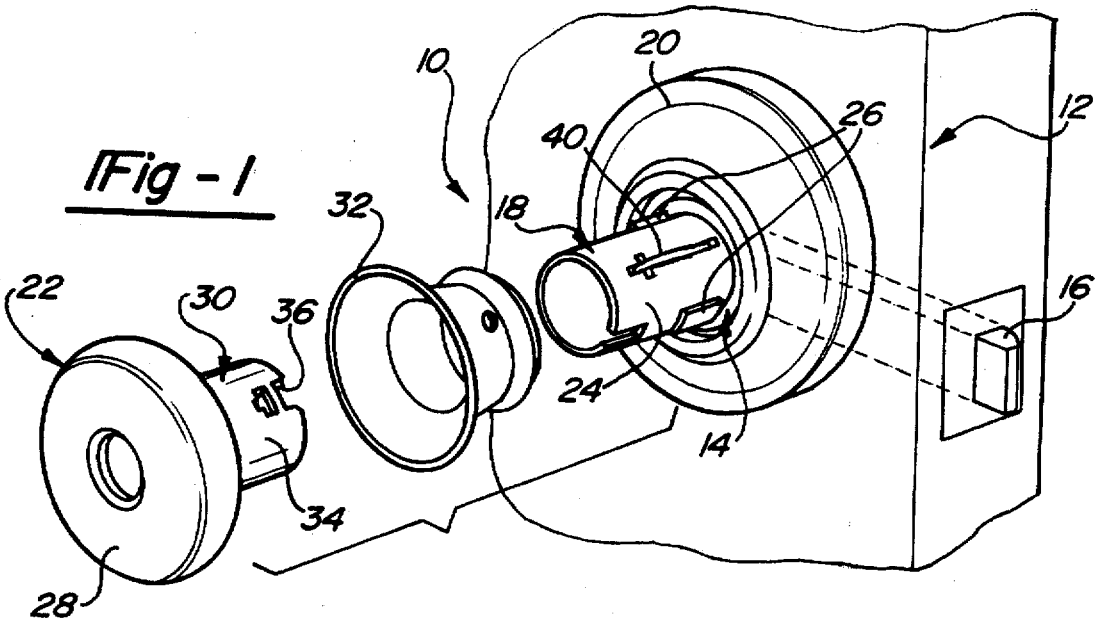
FIG. 1 is a perspective view of a lock assembly mounted within a door and embodying the present invention.

Referring first to FIG. 1, there is shown an exploded perspective view of a lock assembly 10 mounted to a door 12 for selectively latching the door 12 in a door passageway (not shown). The lock assembly 10 includes an internal lock mechanism 14 mounted within the door 12 and having a bolt 16 extending transversely through the edge of the door 12 and a lock spindle 18 extending perpendicular to the door 12. A decorative rosette 20 conceals the lock mechanism 14 within the door 12. A door knob assembly 22 is operably connected to the spindle 18. It is to be understood with respect to the scope of the present invention that the knob assembly 22 of a lever assembly may be used in conjunction with the lock assembly of the present invention. For clearness of understanding, the present invention will be described simply with a knob assembly. The knob or lever allows the user to operate the lock mechanism 14 in turn retracting the bolt 16 as necessary.

Figure 2:
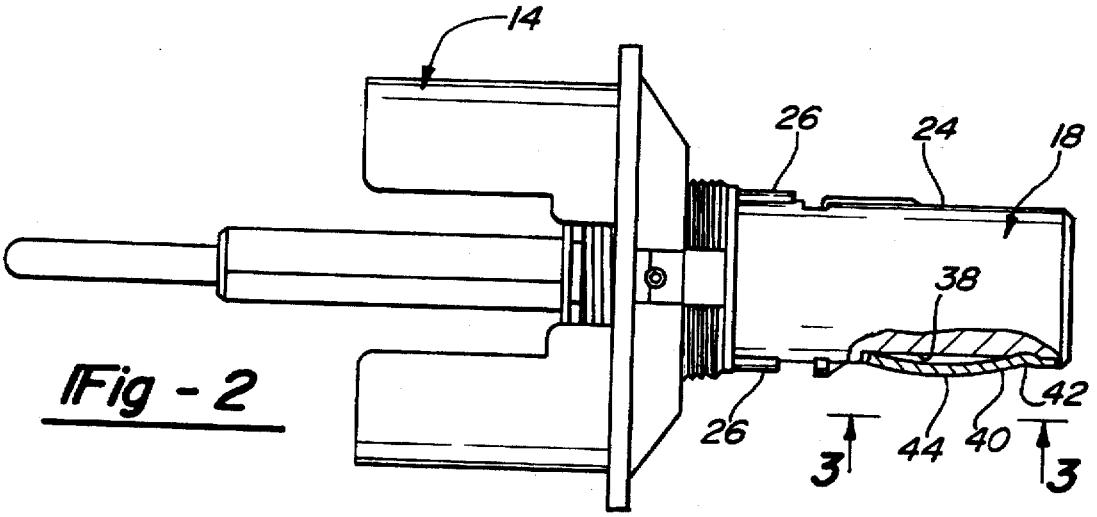
FIG. 2 is a partial view of the lock assembly.
Figure 3:
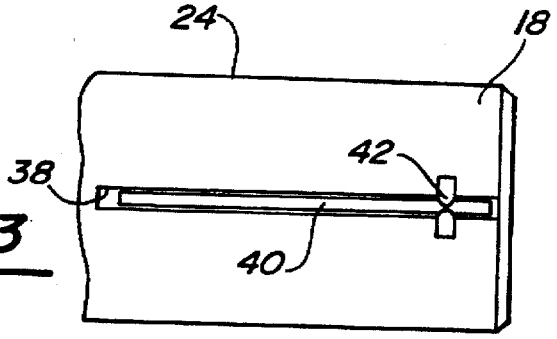
FIG. 3 is an enlarged view of the lock spindle showing a spring mounted thereon.

Referring now to FIGS. 1 through 3, the spindle 18 is preferably a zinc die casting with a substantially tubular configuration. A lock cylinder (not shown) is received within the spindle 18 and extends through the knob 22 for locking control of the lock assembly. Formed on an outer surface 24 of the spindle 18 is at least one lug 26. Preferably, the spindle 18 includes a pair of lugs 26 to orient the knob assembly 22 on the spindle 18 as will be subsequently described. The width, length and/or position of the lugs 26 can be varied to ensure a specific orientation. In a preferred embodiment shown in the drawings, the lugs 26 are positioned on diametrically opposite sides of the spindle 18 but have different widths.

The knob assembly 22 includes a knob body 28 having a shank 30 attached thereto and a shank cover 32 configured to conceal the shank 30 and the connection between the knob assembly 22 and the spindle 18 creating an aesthetically appealing lock assembly 10. The shank 30 has a neck portion 34 which includes notches 36 corresponding to the lugs 26 of the spindle 18. As with the lugs 26, the notches 36 have a width, depth and/or position which ensures that the knob assembly 22 can be mounted to the spindle 18 in only one orientation.

Connection of the notches 36 with the lugs 26 creates a gearing interaction such that rotation of the knob assembly 22 translates to the spindle 18 to operate the lock mechanism 14.

As best shown in FIGS. 2 and 3, the spindle 18 includes a longitudinal slot 38 formed in the outer surface 24. Seated within the slot 38 is a bow spring 40. In a preferred embodiment, with the spring 40 positioned within the slot 38, the spring 40 is crimped 42 to secure the spring 40 in the slot 38. The spring 40 is bowed such that the ends remain within the slot 38 to prevent gouging of the knob shank 30. The bow or vertex 44 of the spring 40 extends beyond the periphery of the outer surface 24 of the spindle 18. As a result, the spring 40 will biasingly engage the interior of the knob shank 30 as the knob assembly 22 is slid onto the spindle 18. This biasing engagement takes-up or eliminates the tolerances between the spindle 18 and knob assembly 22 providing a solid connection. Accordingly, die cast components may be used with greater tolerances while maintaining the quality feel of the lock assembly 10. The bias of the spring 40 eliminates both lateral freedom which would cause the knob 22 to rattle on the spindle and rotational freedom which would allows the knob or lever to rotate slightly before translating rotation to the spindle 18 and the lock mechanism 14.

The foregoing detailed description has been given for clearness of understanding only and no unnecessary limitations should be understood therefrom as some modifications will be obvious to those skilled in the art without departing from the scope and spirit of the appended claims.

What is claimed is:

1. In a lock assembly having a locking mechanism disposed within a door, the locking mechanism including a cylindrical spindle extending therefrom to which an operating member is operably mounted, the improvement comprising:

a biasing member mounted to the spindle and biasingly engaging the operating member, said biasing member including a bow spring mounted to the spindle and having a substantially curved configuration with ends of said bow spring in engagement with a slot in the spindle such that a vertex of said bow spring is disposed beyond an outer periphery of the spindle; and at least one lug formed on the spindle drivingly engaged by the operating member to translate rotation of the operating member to the spindle.

2. The improvement as defined in claim 1 wherein said biasing member is mounted within a slot formed in the spindle, a portion of said biasing member extending beyond an outer periphery of the spindle.

3. The improvement as defined in claim 1 wherein said slot is formed longitudinally in an outer surface of the spindle, said spring disposed longitudinally on the spindle.

4. The improvement as defined in claim 3 wherein the operating member includes a neck portion adapted to matingly receive the spindle, said spring biasingly engaging an interior surface of the operating member neck portion.

5. The improvement as defined in claim 1 wherein said at least one lug includes a pair of lugs formed on the spindle, the operating member having corresponding notches which drivingly engage said lugs.

6. In a lock assembly having a locking mechanism disposed within a door, the locking mechanism including a cylindrical spindle extending therefrom to which an operating member is operably mounted, the improvement comprising:

a detachable bow spring mounted within a longitudinal slot formed in the spindle, said bow spring having a pair of ends disposed within said slot of the spindle and a vertex disposed beyond an outer periphery of the spindle for biasingly engaging an interior surface of the operating member; and a pair of lugs formed on the spindle and drivingly engaged by the operating member such that rotation of the operating member translates through said lugs to the spindle to operate the locking mechanism.

7. The improvement as defined in claim 6 wherein the operating member includes a neck portion adapted to matingly receive the spindle, said spring biasingly engaging an interior surface of the operating member neck portion.

8. The improvement as defined in claim 7 wherein said pair of lugs formed on the spindle are drivingly engaged by corresponding notches formed on the operating member.

* * * * *